United States Patent [19]

Chovan

[11] 4,065,865

[45] Jan. 3, 1978

[54] DEVICE FOR VISUALLY DISPLAYING LUMINOUS PATTERNS

[75] Inventor: Stephan Chovan, Caluire, France

[73] Assignee: Societe Cyberson, Lyon, France

[21] Appl. No.: 710,634

[22] Filed: Aug. 2, 1976

[30] Foreign Application Priority Data

Aug. 1, 1975 France ..... 75.24753

[51] Int. Cl.[2] ..... G09F 13/00; F21P 1/02

[52] U.S. Cl. ..... 40/444; 40/457; 40/546; 40/560; 40/10 R; 40/577; 40/581; 40/906; 362/248

[58] Field of Search ..... 40/106.52, 106.53, 133 R, 40/133 A, 132 R, 132 E, 132 F, 132 G, 132 D, 130 B, 130 R, 130 F, 130 N, 70 R, 34; 240/10 R, 10.1

[56] References Cited

U.S. PATENT DOCUMENTS

| | | | |
|---|---|---|---|
| 1,880,026 | 9/1932 | Singerman | 240/10 R |
| 3,425,146 | 2/1969 | Winstanley | 240/10 R X |
| 3,757,106 | 9/1973 | Bau et al. | 240/10 R |
| 3,777,134 | 12/1973 | Conner | 240/10 R |
| 3,790,772 | 2/1974 | Newman et al. | 40/132 D X |
| 3,806,722 | 4/1974 | Peake et al. | 240/10 R |
| 3,949,350 | 6/1976 | Smith | 240/10 R |

*Primary Examiner*—John F. Pitrelli
*Attorney, Agent, or Firm*—Karl F. Ross

[57] ABSTRACT

A multiplicity of preferably coherent light sources are disposed along a common axis and are separated from one another by interposed opaque shields in the form of disks of progressively increasing diameters transverse to that axis. Each source confronts an associated screen with an annular light-receiving zone, which (except in the case of the last screen) may be integral with the respective shields, illuminated by light from all the preceding sources. The light sources may be individually modulated by external signals, e.g. oscillations derived from sound waves, to provide a visual pattern thereof.

9 Claims, 5 Drawing Figures

FIG. 1
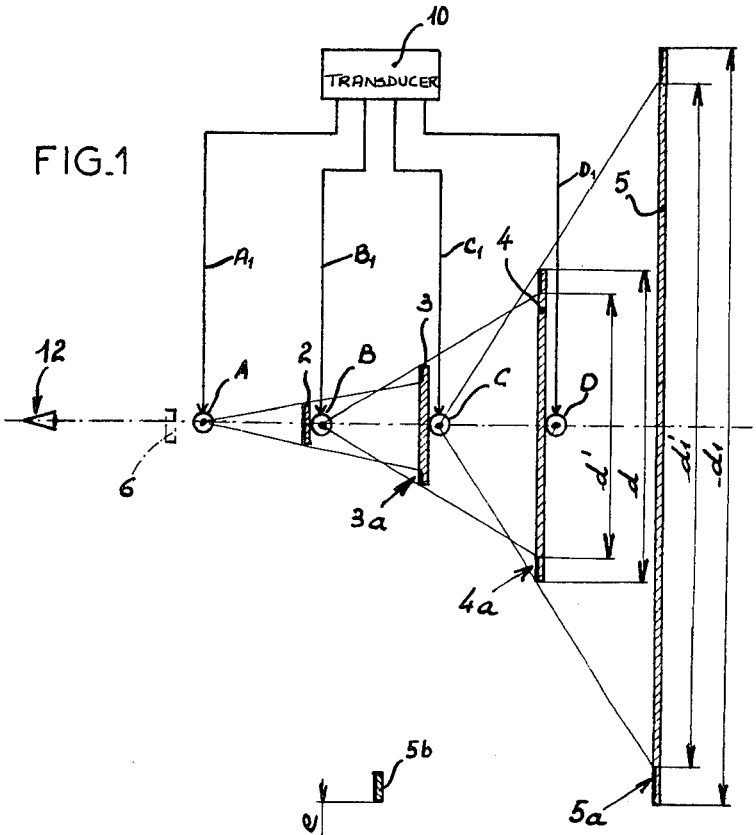
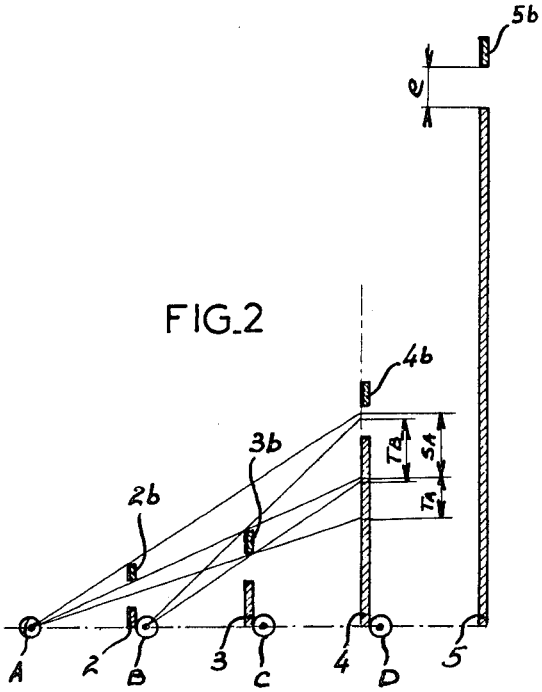
FIG. 2

19
5e
4e
3e
19
12
A
B
C
D
2
3'
4'
5'
D1
A1
B1
C1
19
14
13
17
AMP.
MOD.
16
15
SOUND-WAVE SOURCE
18

DEVICE FOR VISUALLY DISPLAYING LUMINOUS PATTERNS

FIELD OF THE INVENTION

My present invention relates to a device for visually displaying luminous patterns with the aid of several light sources, modulated or not, whose interplay on a receiving surface creates various optical effects such as color changes or interference fringes.

BACKGROUND OF THE INVENTION

It is known, e.g. from French utility model No. 72.19581 of May 19, 1972, to provide an ornamental illumination device in which two colored light sources are disposed on opposite sides of a colored screen for producing, on the screen and on an associated reflector, interference fringes differing from one another and varying in hue and distribution with changes in the luminous flux emitted by the sources.

OBJECT OF THE INVENTION

The object of my present invention is to provide a display device of this general character which is more versatile than the conventional one and which offers wider possibilities of visually displaying external signals such as, for example, oscillations derived from sound waves.

SUMMARY OF THE INVENTION

I realize this object, in conformity with my present invention, by providing a multiplicity of light sources disposed more or less on a common axis and separated from one another by interposed opaque shields, preferably in the form of circular disks, whose widths transverse to the axis progressively increase in a direction away from an observation point located at or near that axis ahead of the first source. Each of these sources illuminates an associated screen having a preferably annular light-receiving zone positioned to be illuminated by light from all the preceding sources. The light-receiving zones, except for the one confronting the last source, may be aligned with the respective shields but could also be axially offset therefrom; in fact, these zones may constitute marginal extensions of the shields. Alternatively, they may be separated from the associated shields by annular gaps designed to let light from the preceding source or sources reach the following receiving zone or zones. If desired, the receiving zones may have surfaces distinctively different from those of the shields, e.g. more highly reflective; on the other hand, the shield surfaces or parts thereof could also be used for display purposes.

The light sources may be either monochromatic or polychromatic and are preferably of the coherent type, e.g. lasers, in order to generate interference fringes.

According to a more particular feature of my invention, these light sources are individually modulated in amplitude or possibly in phase under the control of external signals to be visualized. If these signals are sound waves or their electrical equivalents, the device will allow a listener to correlate sound effects and luminous patterns, e.g. for the purpose of deepening musical appreciation. Its 3-dimensional display stimulates recognition of variations in pitch, timbre and intensity. Thus, the device will also be useful as a help to enunciation by enabling the visual analysis of one's own spoken words.

BRIEF DESCRIPTION OF THE DRAWING

The above and other features of my invention will now be described in detail with reference to the accompanying drawing in which:

FIG. 1 is a somewhat diagrammatic view, in axial section, of a display device according to the invention;

FIGS. 2, 3 and 4 are views similar to FIG. 1 (with the lower half of the device omitted), showing several modifications.

SPECIFIC DESCRIPTION

Figure 3:
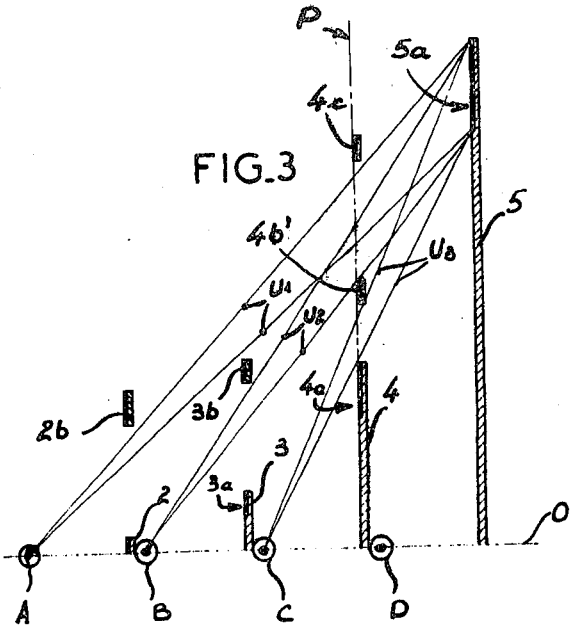

In FIG. 1 I have shown at 12 an observation point located along an axis O on which four preferably coherent light sources A, B, C and D are spacedly disposed. They have been represented as point sources but could also have a different shape; furthermore, their alignment along axis O is convenient but not essential. Each source A, B, C, D confronts a respective disk 2, 3, 4 and 5 forming an opaque screen centered on that axis. Annular portions 3*a*, 4*a* and 5*a* of disks 3, 4 and 5 serve as light-receiving zones exposed to rays from all the preceding sources, i.e. emitters A and B in the case of zones 3*a*, A, B and C in the case of zone 4*a* and A – D in the case of zone 5*a*. The entire surface of disk 2 is illuminated by source A and may therefore also be considered a light-receiving zone. A shutter 6 may be interposed between the first source A and the eye of an observer at point 12 if that source is not designed to radiate only in the forward direction (i.e. from left to right), as by being provided with a hemispherical reflector.

Disks 2, 3 and 4 act as light shields casting shadows upon the following disks. The diameters of disks A – D increase progressively to such an extent that the annular zone 3*a* of disk 3 lies outside the circular area of the front face of disk 3 obscured by the preceding disk 2, that area being defined by the intersection of this front face with a truncated shadow cone having its vertex at source A.

A similar truncated shadow cone, with a vertex at source B, is generated by the shield 3 and obscures a circular area of disk 4 just inwardly of zone 4*a;* the diameter of this obscured area, designated d′ in FIG. 1, is less than the diameter *d* of disk 4. An analogous situation exists with reference to source C, shield 4 and disk 5, the diameter $d_1$ of the latter disk exceeding the diameter $d'_1$ of its shadow area.

Thus, an observer viewing the array of disks from the observation point 12 will see differently illuminated concentric areas formed by the front of disk 2 and by the receiving zones 3*a*, 4*a* and 5*a* of disks 3 – 5.

If these sources emit polychromatic (e.g. white) but coherent light, interference fringes in the form of alternately light and dark concentric rings will appear on screen zones 3*a*, 4*a* and 5*a*. If the emissions are monochromatic and of different frequencies, the interference fringes will also have a distinct color pattern.

At 10 I have illustrated a control circuit with outputs $A_1$, $B_1$, $C_1$ and $D_1$ serving to modulate the luminous flux from each source, e.g. as more fully described hereinafter with reference to FIG. 5.

The light emitted by sources A, B and C need not pass around the confronting receiving zones in order to reach other zones therebeyond, as shown in FIG. 12, but could also pass between these receiving zones and the central portions of the associated screens acting as light shields for the screens next in line. This has been illustrated in FIG. 2 where disks 2, 3 and 4 are spacedly surrounded by coaxial and coplanar rings 2*b*, 3*b* and 4*b*, respectively, thereby defining annular gaps of radial width *e* through which the light rays may pass. Again, downstream receiving zones such as the front faces of rings 3*b* and 4*b* are so disposed as to be illuminated by light rays from all the upstream sources passing either around the preceding rings or through the gaps formed between these rings and the associated light shields. Thus, ring 4*b* lies outside two annular shadow areas $T_A$, $T_B$, respectively cast by ring 3*b* upon disk 4 with regard to light from source A, and also outside a similar shadow area $S_A$ produced by ring 2*b* with regard to light from source A.

The disk 5 of FIG. 2 has also been shown spacedly surrounded by a ring 5*b* forming a receiving zone. It will be understood, however, that the annular gap separating the disk 5 from the ring 5*b* will be needed only if the array includes at least one other illumination stage downstream of stage D, 5; otherwise, a marginal portion of disk 5 will serve as its illumination zone receiving light from all the sources A – D.

It will be understood that suitable mounting means, not shown, are provided for supporting the coaxial disks and their surrounding rings in the several embodiments described.

By combining the features of FIGS. 1 and 2 I may provide a combination of receiving zones integral with and radially spaced from the associated shields as has been illustrated in FIG. 3. Thus, rings 2*b*, 3*b* and 4*b* of FIG. 3 surround disks 2, 3 and 4 as in FIG. 2 yet disks 3 and 4 are also provided with secondary screen portions forming annular zones 3*a* and 4*a* which are illuminated by the preceding light sources as in FIG. 2.

By way of illustration, I have indicated in FIG. 3 the limiting rays of light cones $U_1$, $U_2$ and $U_3$ reaching the receiving zone 5*a* from sources A, B and C, respectively. It will thus be noted that the inner and outer diameters of rings 2*b*, 3*b* and 4*b* are so chosen that these rings do not obscure the receiving zones of subsequent stages. A further annular receiving zone 4*c*, lying in a common plane P with zones 4*a* and 4*b* associated with disk 4, can also be reached by light from the preceding sources A, B and C. The radial staggering of all these zones should of course be so chosen that they can be separately observed by a viewer from a remote location such as the point 12 of FIG. 1. Naturally, the addition of further annular receiving zones such as that of ring 4*c* depends on the space available around axis O.

If more than the marginal zone 5*a* of disk 5 is to be used as a display area, the light projected upon it may be interrupted by shadows cast by some of the secondary screen portions such as, for example, the ring 4*b* intercepting light from source A. This is not necessarily a drawback inasmuch as the darker rings may serve as boundaries for the zones displaying different interference phenomena.

Figure 4:
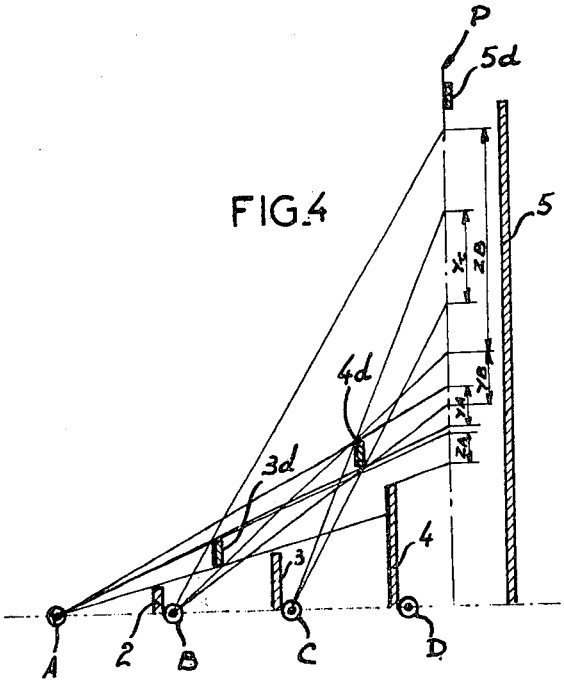

The embodiment of FIG. 4 differs from that of FIG. 2 by an axial forward displacement of annular screen portions 3*d*, 4*d* and 5*d* with reference to the corresponding disk bodies 3, 4 and 4. Again, the receiving zones of these rings are so staggered as not to obstruct one another as regards their illumination from any preceding source as well as their viewing from an observation point. Thus, shadow rings $Y_A$, $Y_B$ and $Y_C$ are cast by the secondary annular screens 4*d* upon the plane P of screen 5*d* with regard to light from sources A, B, respectively; similar shadow rings $Z_A$ and $Z_B$ result from the presence of annular screen 3*d* between plane P and sources A, B. Zone 5*d* lies beyond all these shadow rings so as to be illuminated by all four sources A – D.

Again, additional receiving zones, such as the one shown at 4*c* in FIG. 3 (not necessarily in line with disks 3, 4 or rings 3*d* – 5*d*), can be provided if space permits.

Figure 5:
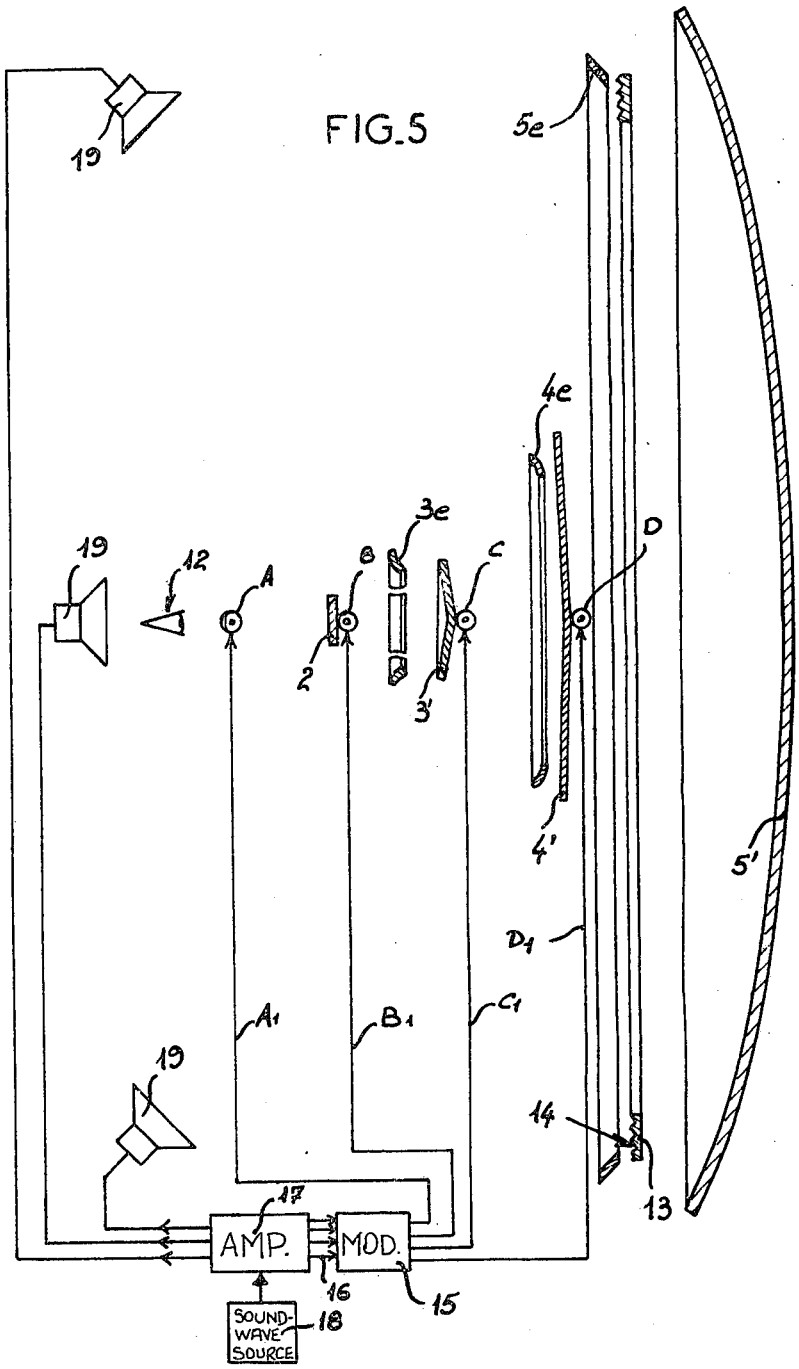
FIG. 5 is a further view similar to FIG. 1, illustrating the use of the device for the visualization of sounds.

In FIG. 5 the screens 3, 4 and 5, constituted by flat disks, have been replaced by structures of different configurations, i.e. a conical shield 3', a dihedral shield 4' and a cup-shaped screen 5' of spherical or ellipsoidal curvature. The secondary screens forming the annular receiving zones also have different shapes, i.e. a segmented toroid 3*e* of arcuate, forwardly convex cross-section, a toroid 4*e* of forwardly concave arcuate cross-section and a forwardly diverging frustocone 5*e*. there is also shown a translucent ring 13 with a corrugated front surface 14 whose concentric annular V-grooves impart additional nuances to the pattern of the interference fringes projected thereon.

Let us assume, by way of example, that sources A, B, C and D emit monochromatic light of the colors green, yellow, red and blue, respectively. The receiving sources illuminated thereby will then reflect various color combinations such as a more or less deep green in the case of surface 3*a* and a variety of hues ranging from chestnut through bright green and orange to orange-green in the case of surface 4*a*.

FIG. 5 further shows how these shades can be varied by modulating the emission of sources A – D in respect to sound waves. A source 18 of such sound waves, e.g. a record player, works into an amplifier 17 with four outputs 16 extending to a set of modulators 15 to engage the control leads $A_1$ – $D_1$ of sources A – D. It may be assumed, for example, that the four outputs 16 respectively carry low, medium-low, medium-high and high frequencies so that the corresponding luminous emissions vary with the intensities of the sound waves in these frequency bands. Amplifier 17 also energizes several loudspeakers 19 to enable observers to associate the sound with the luminous pattern viewed from point 12.

If the electro-acoustic transducer 18 comprises a microphone in lieu of a record player or other passive source, the system of FIG. 5 can be used as an educational device for the correction of speech defects aided by the observation of visual patterns and their comparison with a reference pattern. This can also be useful for persons hard of hearing who can thereby adapt their speech to that of normal persons; furthermore, deaf and near-deaf persons can be helped to enjoy a musical performance without acoustic amplification.

I claim:

1. A device for visually displaying luminous patterns, comprising:

a multiplicity of *n* light sources radiating in a direction away from a predetermined observation point, said sources being spaced apart in said direction and located on a common axis; and screen means forming a plurality of light-receiving zones viewable from said observation point, said zones being spaced apart in said direction and staggered transversely thereto for illumination by light from different combinations of said sources, said screen means forming (*n*-1) opaque shields interposed between successive light sources, and centered on said common axis, said shields having widths transverse to said direction increasing with distance from said observation point, said zones being transversely offset from said shields and positioned for illumination by light from a number of said sources increasing with distance from said observation point, said zones including rings centered on said axis having inner and outer diameters increasing with distance from said observation point.

2. A device as defined in claim 1 wherein at least some of said zones are unitary with respective shields.

3. A device as defined in claim 2 wherein at least some of said zones spacedly surround respective shields.

4. A device as defined in claim 1 wherein said zones include a face on the shield closest to said observation point and a terminal surface beyond the last source.

5. A device as defined in claim 1 wherein said sources are emitters of coherent light.

6. A device as defined in claim 1 wherein at least one of said zones has a corrugated face confronting said observation point.

7. A device as defined in claim 6 wherein said one of said zones is provided on a translucent carrier and lies in front of another light-receiving zone.

8. A device as defined in claim 1, further comprising modulating means for varying the luminous emissions of said sources under the control of external signals.

9. a device as defined in claim 8 wherein said modulating means comprises an electro-acoustic transducer.

* * * * *